US007427086B2

(12) United States Patent
Park et al.

(10) Patent No.: US 7,427,086 B2
(45) Date of Patent: Sep. 23, 2008

(54) DOOR ASSEMBLY

(75) Inventors: Myung Sik Park, Changwon-si (KR); Kwang Soo Kim, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 211 days.

(21) Appl. No.: 10/865,766

(22) Filed: Jun. 14, 2004

(65) Prior Publication Data

US 2005/0044898 A1 Mar. 3, 2005

(30) Foreign Application Priority Data

Aug. 26, 2003 (KR) ..... 10-2003-0059146

(51) Int. Cl.
*E05C 19/10* (2006.01)
*D06F 37/28* (2006.01)

(52) U.S. Cl. ..... 292/95; 292/121; 292/128; 292/DIG. 69; 68/12.26

(58) Field of Classification Search ..... 292/95, 292/96, 101, 108, 121, 122, 128, 230, 238, 292/202, 304, 100, DIG. 11, DIG. 53, DIG. 54, 292/DIG. 64, DIG. 69, DIG. 61; 68/3 R, 68/12.01, 12.26, 196
See application file for complete search history.

(56) References Cited

U.S. PATENT DOCUMENTS 93,930 A * 8/1869 Westcott ..... 292/128
613,812 A * 11/1898 Alberswerth ..... 292/128
5,292,159 A * 3/1994 Sandhu et al. ..... 292/173
5,630,630 A * 5/1997 Price et al. ..... 292/128
5,823,583 A * 10/1998 Sandhu et al. ..... 292/173
6,076,869 A * 6/2000 Chen et al. ..... 292/202
6,666,484 B1 * 12/2003 Branch et al. ..... 292/128
6,942,257 B2 * 9/2005 Wong et al. ..... 292/128
6,988,752 B2 * 1/2006 Belchine et al. ..... 292/336.3
7,269,981 B2 * 9/2007 Kwon ..... 68/3 R
2004/0244435 A1 * 12/2004 Kim ..... 68/12.26

FOREIGN PATENT DOCUMENTS

CN 1683694 A * 10/2005
DE 3809998 * 10/1989
DE 4216581 * 11/1993
KR 1564323 * 8/2005

* cited by examiner

*Primary Examiner*—Carlos Lugo
(74) *Attorney, Agent, or Firm*—McKenna Long & Aldridge LLP

(57) ABSTRACT

Door assembly including a hook at one side of a cabinet for engagement with a door lock, rotating shafts at opposite sides of the hook, a door frame having an opening for pass through of the hook, a first supporting part on the door frame having a pass through hole for inserting one side of the rotating shaft, and a second supporting part on the door frame having an opened loading groove for loading the other side of the rotating shaft, thereby providing a door assembly which can be assembled readily, and permit more stable operation.

27 Claims, 6 Drawing Sheets

DOOR ASSEMBLY

This application claims the benefit of the Korean Application No. P2003-0059146 filed on Aug. 26, 2003, which is hereby incorporated by reference.

BACKGROUND OF THE INVENTION

1. Field of the Invention

The present invention relates to door assemblies, and more particularly, to a door assembly with an improved hook holding structure.

2. Background of the Related Art

In general, the washing machines wash laundry by using chemical dissolution, and mechanical impact. Of the washing machines, a drum type washing machine has a washing capacity larger than a pulsator type washing machine owing to a drum lying in a horizontal position in the drum type washing machine. Moreover, the drum type washing machine causes almost no problem of laundry entangling.

FIG. 1 illustrates a section of a related art drum type washing machine.

Referring to FIG. 1, the related art drum type washing machine is provided with a cabinet 1, a tub, a drum 20, and a motor. The cabinet 1 has the tub 2 provided therein, and the tub 2 has the cylindrical drum 20 provided therein.

In the meantime, there is a door 100 rotatably mounted on a front of the cabinet 1. The door 100 has one side coupled to the front of the cabinet 1 with a hinge. The door 100 has a hook part 200 at the other side for fastening to a locking part 40.

FIG. 2 illustrates a related art door assembly.

Referring to FIG. 2, the door assembly is provided with a door frame 120, a hook part 200, and a door cover 110. The door frame 120 of an annular form has a door glass (900 in FIG. 1) on an inner side. The hook part 200 is provided at one side of the door frame 120 for fastening the door on the front of the cabinet. The door cover 110 is on a front of the door frame 120.

FIG. 3 illustrates a diagram showing a related art hook assembly of the door assembly.

Referring to FIG. 3, the door assembly is provided with a door frame 120, a hook 310, a spring 330, and supporters 210. The door frame 120 has an opening 230 for pass through of the hook 310, and the hook 310 has rotating shafts 320 at both sides. The spring 330 is fitted to the rotating shaft 320 for providing an elastic force. The spring 330 returns the hook 310 having turned in one direction for engagement with the door lock to an original position.

The supporting parts 210 are spaced a distance away from each other, and projected from the door frame 120, and have holes 220 for inserting the rotating shaft 320.

The related art door assembly is assembled according to the following process.

After inserting the hook 310 in the opening 230 in the door frame 120, one side of the rotating shaft 320 is inserted in the hole 220 of the supporting part 210. Because a total length of both of the rotating shafts 320 is greater than a distance of the supporting parts 210, the rotating shaft 320 is pushed in further along an insertion direction. In this instance, a space for inserting the other side of the rotating shaft 320 into the hole 220 in an opposite supporting part 210 is secured.

Accordingly, once the other side of the rotating shaft 320 is inserted in the hole 220, assembling of the door assembly is finished.

However, there have been cases when it is difficult to push in the rotating shaft in one direction further due to assembly tolerances, and the like. That is, there have been cases when a formation of room required for inserting the other side of the rotating shaft is difficult due to interference of the hook with an edge of the opening in the door frame.

Moreover, there have been cases when the rotating shaft breaks away from the hole when the hook of an assembled door assembly moves in left/right directions along the opening by an external force, such as vibration, or the like.

SUMMARY OF THE INVENTION

Accordingly, the present invention is directed to a door assembly that substantially obviates one or more of the problems due to limitations and disadvantages of the related art.

An object of the present invention is to provide a door assembly which is securer, and of which assembly is more convenient.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the door assembly includes a hook at one side of a cabinet for engagement with a door lock, rotating shafts at opposite sides of the hook, a door frame having an opening for pass through of the hook, a first supporting part on the door frame having a pass through hole for inserting one side of the rotating shaft, and a second supporting part on the door frame having an opened loading groove for loading the other side of the rotating shaft.

The door assembly further includes a door cover on a front of the door frame, and a restraint part extended from a back of the door cover to the opened part of the loading groove, for preventing breaking away of the rotating shafts. The restraint part includes an end having a groove for receiving the rotating shaft inserted in the loading groove.

The loading groove is preferably a snapping groove for snap inserting of the rotating shaft. The opened part of the loading groove has a width smaller than a diameter of the rotating shaft. The door assembly further includes a third supporting part at an outer side of the second supporting part having a restraint pocket for inserting an end of the other side of the rotating shaft. The second supporting part is formed of an elastic material. The door assembly further includes a spring on an outside circumference of the rotating shaft for returning the hook and the rotating shaft to original positions when the hook and the rotating shaft rotate in one direction.

The opening includes a pass through part for pass through of the hook, and a guide part at opposite sides of the pass through part for guiding left/right direction movement of the hook. The guide part has a width smaller than the pass through part.

In other aspect of the present invention, there is provided a door assembly including a hook at one side of a cabinet for engagement with a door lock, rotating shafts at opposite sides of the hook, a door frame having an opening for pass through of the hook, a first supporting part on the door frame having a first loading groove for loading one side of the rotating shaft, and a second supporting part on the door frame having a second loading groove for loading the other side of the rotating shaft.

The door assembly further includes a door cover in front of the door frame, and a restraint part extended from a back of the door cover to each of the loading grooves, for preventing breaking away of the rotating shafts.

The restraint part includes an end having a groove for receiving the rotating shaft inserted in the loading groove. The loading groove is a snapping groove.

The door assembly further includes a third supporting part at an outer side of the supporting part having a restraint pocket for inserting an end of the other side of the rotating shaft. The door assembly as claimed in claim 11, further comprising a spring on an outside circumference of the rotating shaft for returning the hook and the rotating shaft to original positions when the hook and the rotating shaft rotate in one direction.

In another aspect of the present invention, there is provided a door assembly including a hook at one side of a cabinet for engagement with a door lock having rotating shafts at opposite sides thereof, a door frame having an opening for pass through of the hook, a first supporting part on the door frame having a pass through hole for inserting one side of the rotating shaft, a second supporting part on the door frame having a snapping groove for snap insertion of the other side of the rotating shaft, and a third supporting part at an outer side of the supporting part having a restraint pocket for inserting an end of the other side of the rotating shaft.

The door assembly further includes a door cover in front of the door frame, and a restraint part extended from a back of the door cover to the snapping groove, for preventing breaking away of the rotating shafts snapped in the snapping groove.

The opening includes a pass through part for pass through of the hook, and a guide part at opposite sides of the pass through part for guiding left/right direction movement of the hook. The door assembly further includes a spring on an outside circumference of the rotating shaft for returning the hook and the rotating shaft to original positions when the hook and the rotating shaft rotate in one direction.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 4:
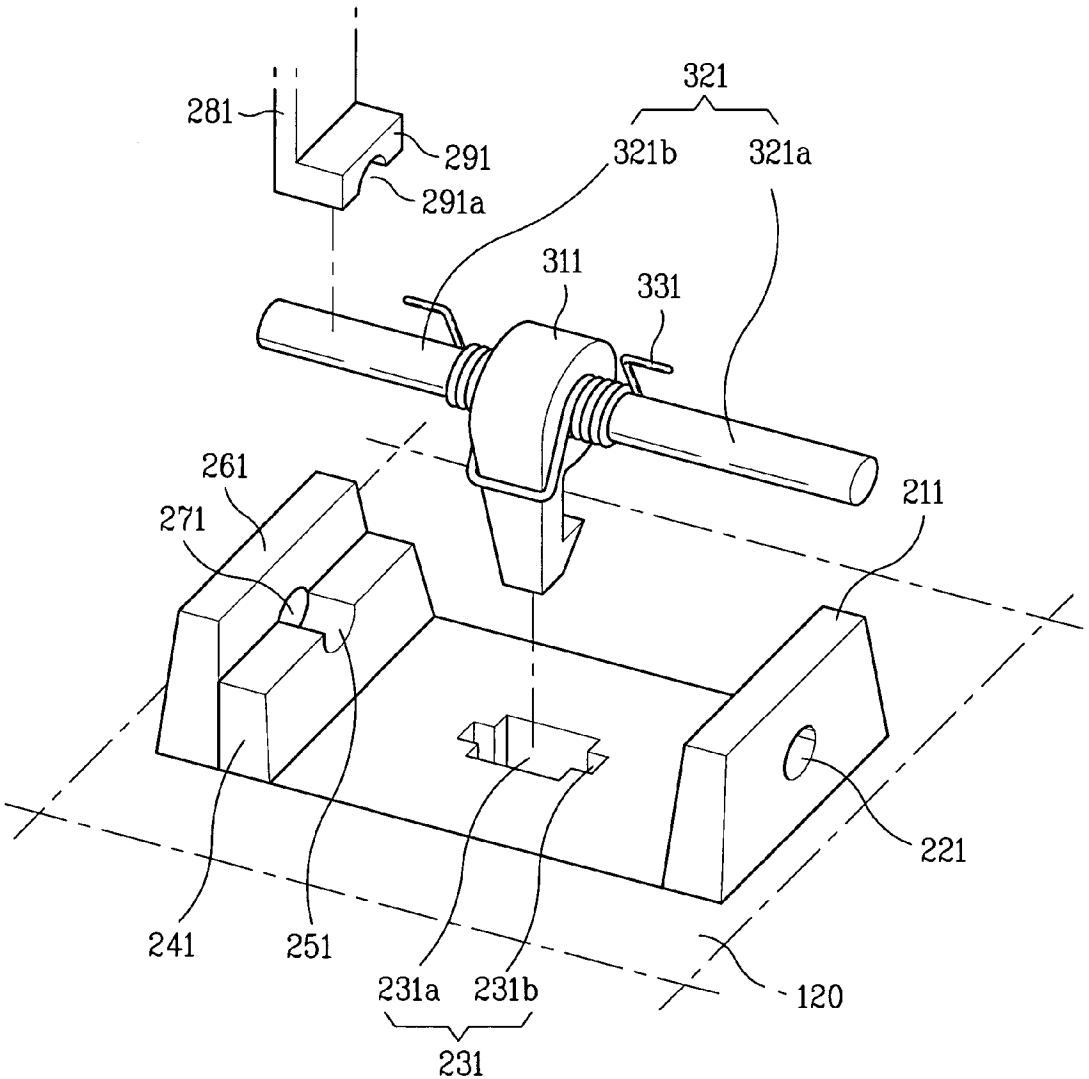
FIG. 4 illustrates a perspective view of an assembling structure of a door assembly in accordance with a preferred embodiment of the present invention.

The door assembly of the present invention will be described, with reference to FIGS. 4 and 5. FIG. 4 illustrates a perspective view of an assembling structure of a door assembly in accordance with a preferred embodiment of the present invention, and FIG. 5 illustrates a front view of a door assembly in accordance with a preferred embodiment of the present invention.

Figure 5:
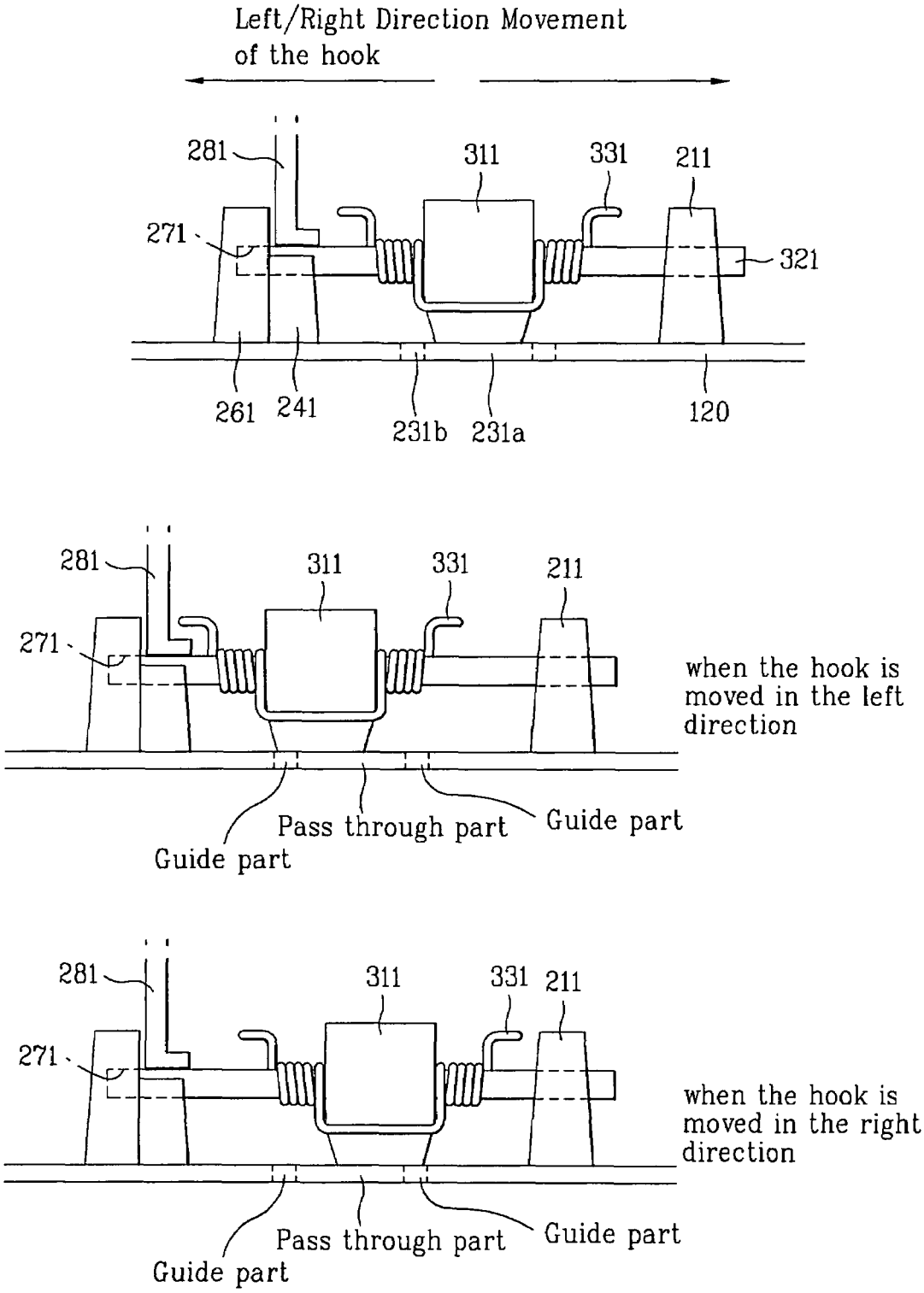
FIG. 5 illustrates a front view of a door assembly in accordance with a preferred embodiment of the present invention.

Referring to FIGS. 4 and 5, the door assembly includes a hook 311, a rotating shaft 321, a door frame 120, and a first supporting part 211, and a second supporting part 241. The hook 311 is projected so as to be engaged with a door lock at one side of the cabinet. For this, the door frame 120 has an opening at one side of the door frame 120 for pass of the hook 311. Moreover, the hook 311 has a rotating shaft 321 extended in a lateral direction from opposite sides.

The supporting parts 211, and 241 are projected from the door frame 120 and spaced a distance from each other on opposite sides of the opening 231.

The first supporting part 211 has a pass through hole 221 for pass of one side of the rotating shaft 321*a*, and the second supporting part 241 has a loading groove 251 having an opened upper side for loading the other side of the rotating shaft 321*b*. The loading groove 251 has a form having cut away an upper part of the hole 221 in the first supporting part.

According to this, one side of the rotating shaft 321*a* is inserted in the hole 221 of the first supporting part 211, the other side of the rotating shaft 321*b* is loaded on the loading groove 251. It is preferable that a center of curvature of the loading groove 251 and a center of the curvature of the rotating shaft 321 have the same height.

Figure 1:
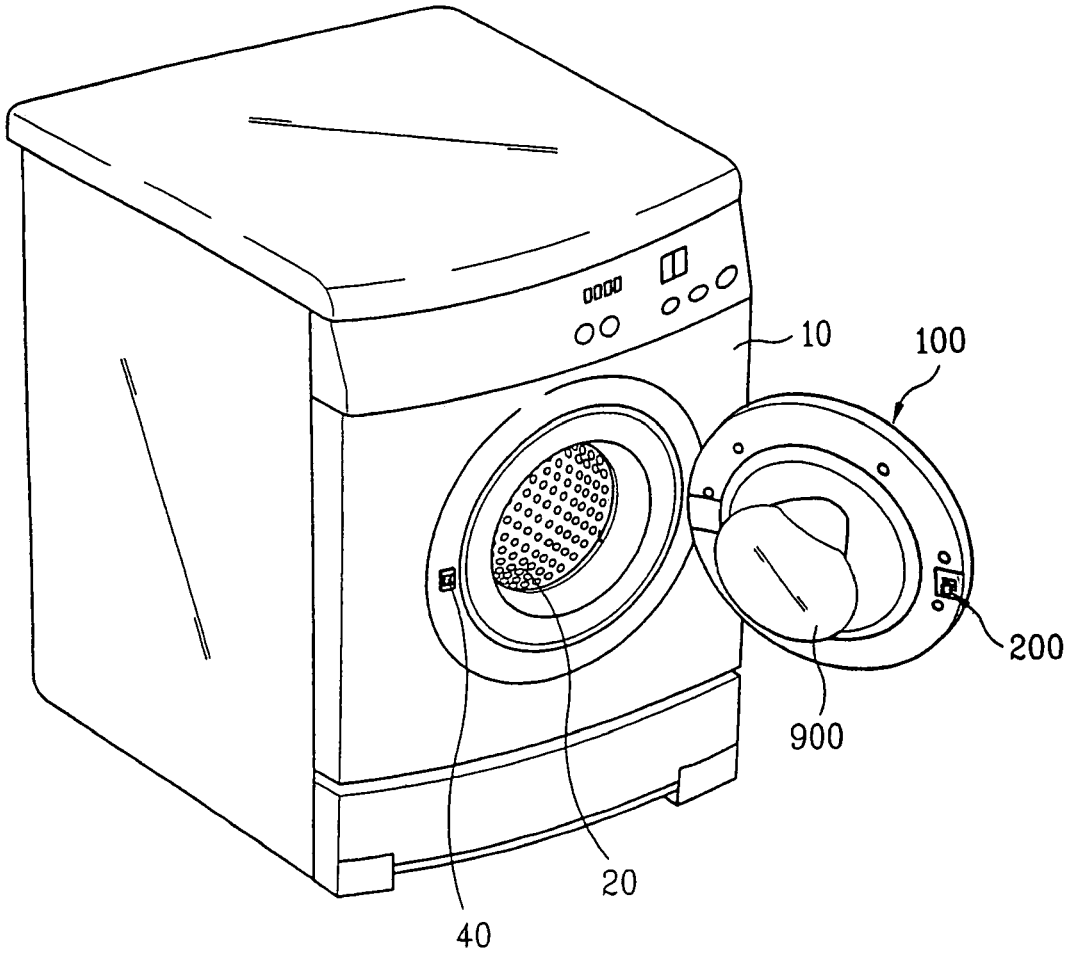
RELATED ART FIG. 1
FIG. 1 illustrates a perspective view of a related art drum type washing machine.
Figure 2:
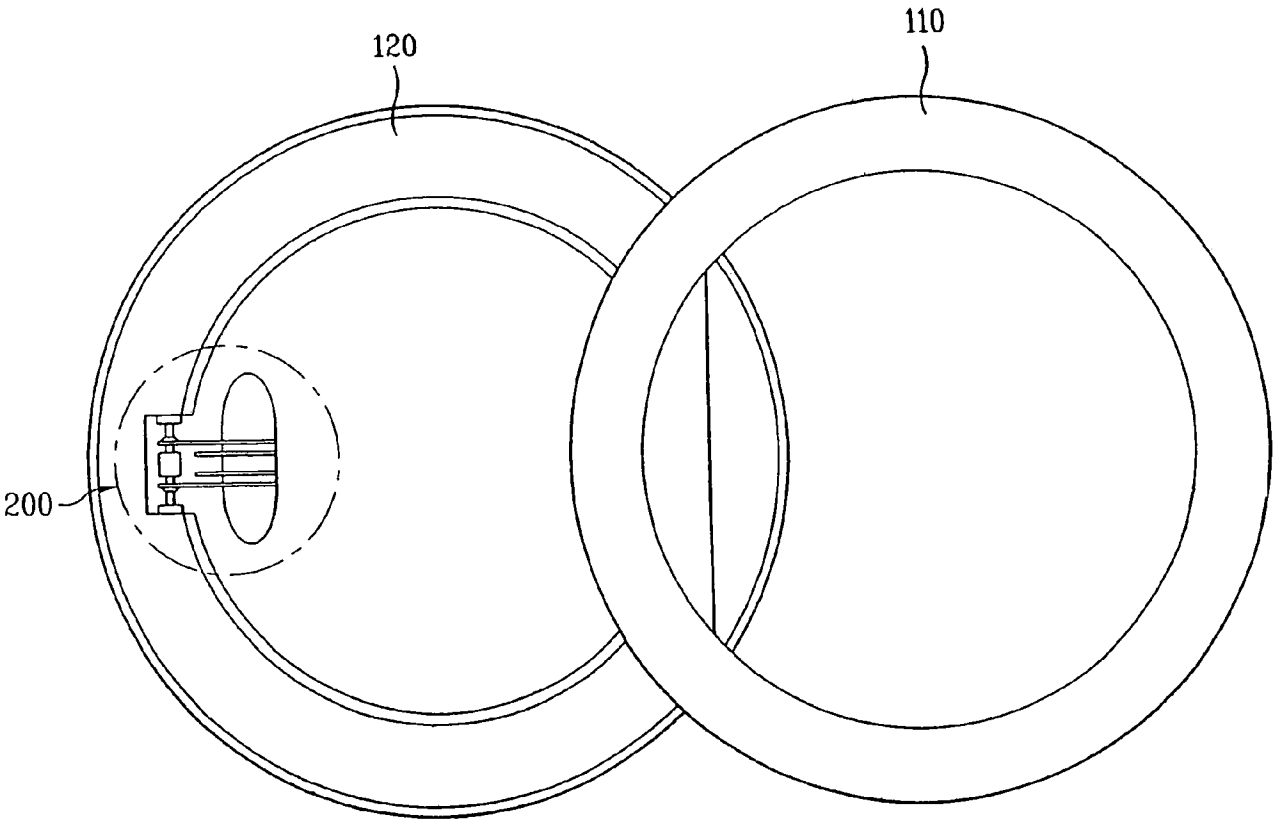
FIG. 2 RELATED ART
FIG. 2 illustrates a plan view of a related art door.
Figure 3:
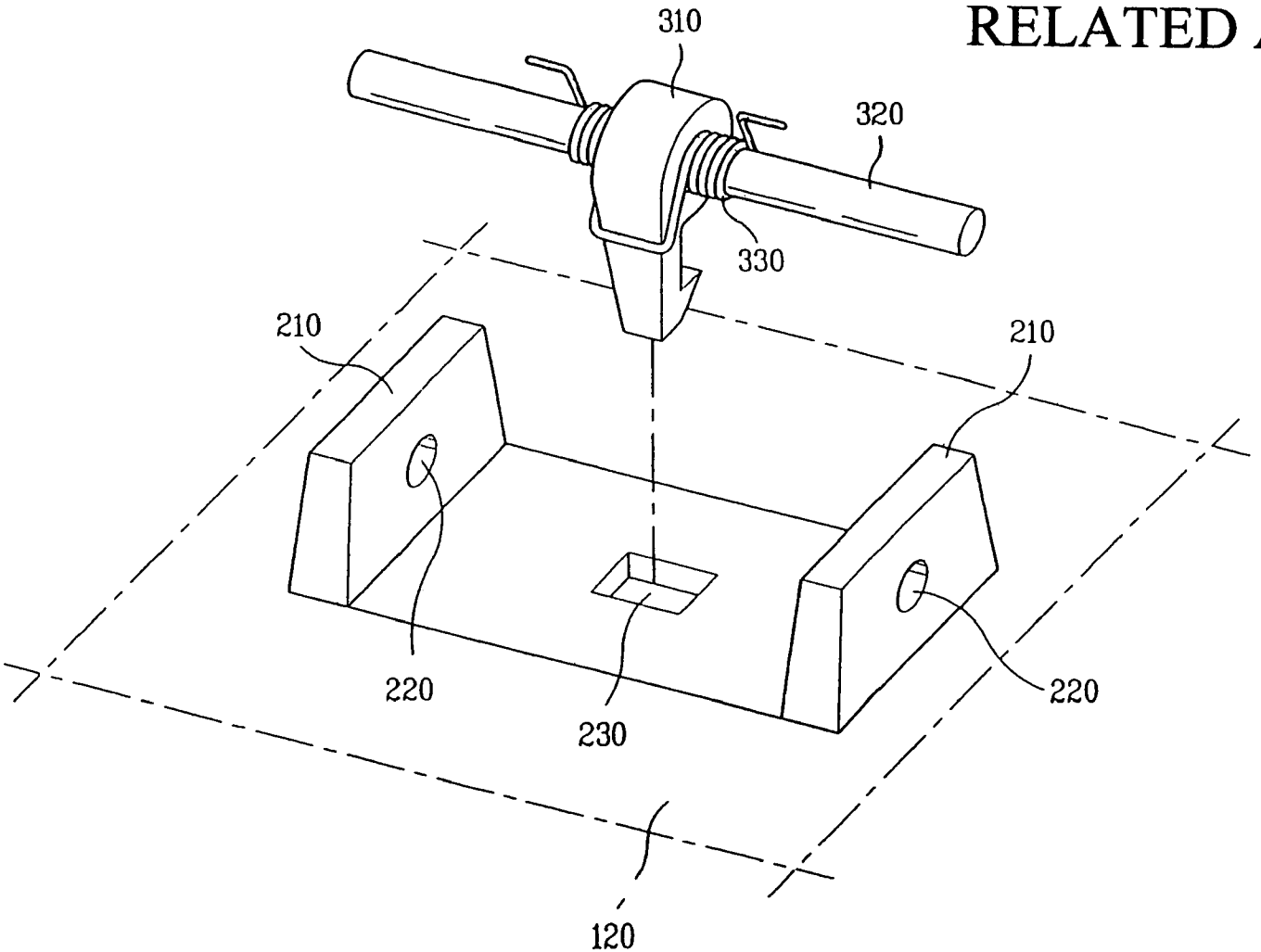
FIG. 3 RELATED ART
FIG. 3 illustrates a perspective view of an assembling structure of a related art door assembly.

In the meantime, the door cover (110 in FIG. 1) is provided to a front of the door frame 120, there is a restraint part 281 on a back of the door cover. For preventing breaking away of the rotating shaft 321 loaded on the loading groove 251, the restraint part 281 is extended from the back of the door cover to the opened part of the loading groove 251. That is, the restraint part 281 is extended vertically from the door cover to a position opposite to the loading groove 251.

In the meantime, the restraint part 281 includes an end having a projection 291 with a groove 291*a* for holding the rotating shaft 321 inserted in the loading groove 251. The groove 291*a* is semicircular to receive the rotating shaft 321.

Therefore, one side of the rotating shaft 321*a* is inserted in the hole 221 and rotatably fixed thereto, and the other side of the rotating shaft 321*b* is loaded in the loading groove 251 and rotatably fixed by the restraint part 281.

In the meantime, there may be a simple plate at an end of the restraint part 281. In this instance, the plate makes surface to surface contact with the rotating shaft 321, and prevents the loading shaft from breaking away from the loading groove 251.

It is preferable that an opened part of the loading groove 251 is smaller than a diameter of the rotating shaft 321. For an example, the loading groove 251 is a snapping groove into which the rotating shaft 321 snaps in. Upon placing the other side of the rotating shaft 321*b* on the opened part of the snapping groove, and pressing the rotating shaft 321*b*, the upper part of the second supporting part 241 is elastically deformed, and the rotating shaft 321 is inserted into the snapping groove 251. According to this, not only the rotating shaft 321 is fitted easily, but also the rotating shaft 321 does not break away.

In order for the elastic deformation at the time of insertion of the rotating shaft 321, it is preferable that the second supporting part 241 is formed of an elastic material. In more detail, the second supporting part 241 is formed of a plastic or metal having an elasticity higher than a certain level.

In the meantime, there is a third supporting part 261 at an outer side of the second supporting part 241. The third supporting part 261 is formed stepwise down to an upper surface of the second supporting part 241. The third supporting part 261 has a restraint pocket 271 for inserting an end of the other side of the rotating shaft 321*b*. Accordingly, the other side of the rotating shaft 321*b* is inserted in the restraint pocket 271 for a certain distance, and held therein.

There is a spring provided to both of the rotating shafts 321. The spring provides an elastic force for returning the hook 311 and the rotating shaft 321 rotated to one direction to an original position. That is, when the door is closing, the hook 311 is inserted into the door lock and fastened thereto. In this instance, it is required that the hook 311 is brought into contact with the front of the door lock, rotates in one direction, and rotates in an opposite direction by the elastic force for hooking at the stopper. Therefore, the spring 331 is required to rotates the hook 311 in an opposite direction, again.

In the meantime, the opening 231 has a pass through part 231*a*, and a guide part 231*b*. The hook 311 passes through the pass through part 231*a*, and the guide part 231*b* is formed at opposite sides of the pass through part 231*a* for guiding left/right side movement of the hook 311. The guide part 231*b* has a width smaller than the pass through part 231*a*. For inserting the other side of the rotating shaft 321*b* in the restraint pocket 271 in the third supporting part 261, the hook 311 is movable in left/right directions following the guide part 231*b*.

After the door assembly is assembled, the hook 311 is placed on the pass through part 231*a*. According to this, the hook 311 is caught at a stepped edge of the pass through part 231*a*, and does not move to the guide part 231*b*.

An assembly process of the door assembly will be described in detail.

After inserting the hook 311 into the opening 231 in the door frame 120, one side of the rotating shaft 321*a* is inserted in the hole 221 in the first supporting part 211.

Then, the other side of the rotating shaft 321*b* is loaded on a loading groove 251 in the second supporting part 241. If the loading groove 251 is a snapping groove, the other side of the rotating shaft 321*b* is placed on the upper side of the loading groove 251, and snapped. In this instance, the opened part of the loading groove 251 is moved apart such that the other side of the rotating shaft 321*b* is inserted into the loading groove 251.

The opened part of the snapping groove has a width slightly greater then a diameter of the rotating shaft 321, and the second supporting part 241 is formed of an elastic material.

Then, if the other side of the rotating shaft 321*b* is pushed toward the third supporting part 261, an end of the other side of the rotating shaft 321*b* is inserted into the restraint pocket 271. The door cover having the restraint part 281 is mounted on the door frame 120.

In this instance, the end of the restraint part 281 is opposite to, and in contact with, the upper part of the loading groove 251. According to this, the restraint part 281 prevents the rotating shaft 321 from breaking away from the loading groove 251.

Figure 6:
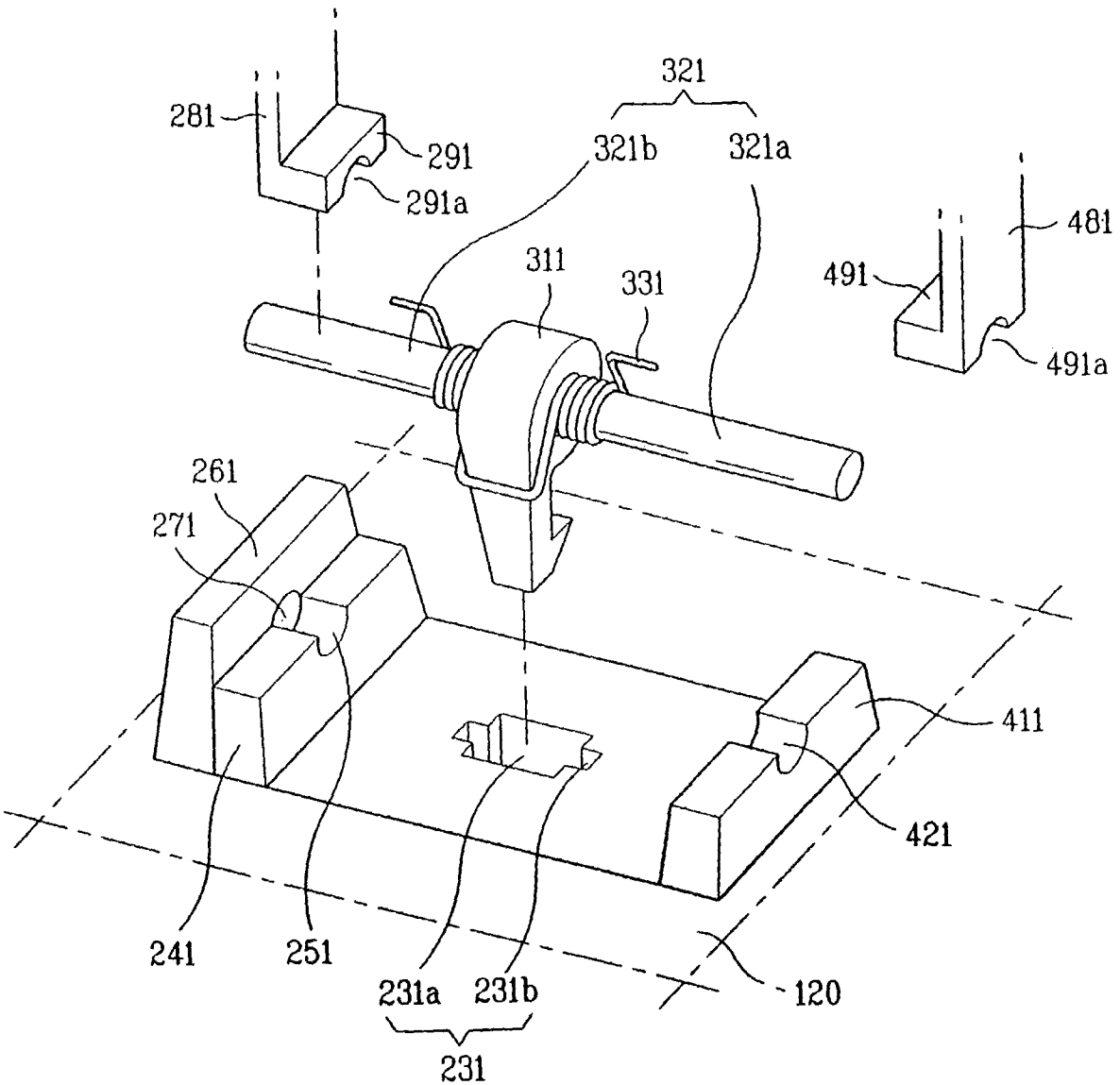
FIG. 6 illustrates a perspective view of an assembling structure of a door assembly in accordance with other preferred embodiment of the present invention.

FIG. 6 illustrates a perspective view of an assembling structure of a door assembly in accordance with other preferred embodiment of the present invention.

Referring to FIG. 6, in the other embodiment, both of the supporting parts 411 and 241 have loading grooves. The door cover has restraint parts 481, and 281 at opposite positions of the supporting parts 411, and 241.

The rotating shafts 321 are loaded on the loading grooves 421, and 251, and restrained by the restraint parts 481, and 281 respectively. There is a third supporting part at an outer side of the supporting part. The third supporting part has a restraint pocket 271 for inserting an end of the other side of the rotating shaft 321*b*.

An assembly process of the door assembly in accordance with other embodiment of the present invention will be described.

After placing both of the rotating shafts 321 at opposite sides of the hook 311 on the loading grooves 421, and 251 respectively, an end of the rotating shaft 321 is inserted into the restraint pocket 271. It is preferable that the loading groove 251 is a snapping groove for snapping insert of the rotating shaft 321. If the rotating shaft 321 is snap inserted, breaking away of the rotating shaft 321 from a regular position by vibration caused in the assembly process can be prevented.

Then, the door cover is mounted on the front of the door frame 120. In this instance, the restraint parts 481, and 281 extended from the door cover restraint upper parts of the opposite supporting part 411, and 241. According to this, breaking away of the rotating shafts 321 from the loading grooves 421 and 251 are prevented.

Both of the restraint parts 481, and 281 include ends having projection 491 and 291 with grooves 491*a*, and 291*a* for receiving the rotating shafts 321, respectively. In this instance, a part of each of the rotating shafts 321 is received in the loading groove 421, or 251, and the other part of each of the rotating shafts 321 is received in the loading groove 421, or 251 is received in the groove 491*a*, or 291*a* in the restraint part 481, or 281. According to this, the rotating shafts 321 can be rotatably secured in the loading grooves 421, and 251, respectively.

As has been described, the door assembly of the present invention has the following advantages.

First, assembly is easy as the assembly can be done once the other side of the rotating shaft is loaded in the loading groove after one side of the rotating shaft is inserted into the supporting part.

Second, if the loading groove is a snapping groove, breaking away of the rotating shafts from regular positions caused by vibration applied in the assembly process can be prevented. Accordingly, the assembly is easy because the rotating shaft keeps a regular position until the door cover is mounted.

Third, the prevention of breaking away of the rotating shafts from the loading grooves owing to the restraint parts permits improvement of product reliability.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A door assembly comprising:

a hook at one side of a cabinet for engagement with a door lock;

a rotating shaft at opposite sides of the hook;

a door frame having an opening for pass through of the hook;

a first supporting part on the door frame for supporting one side of the rotating shaft; and a second supporting part on the door frame for supporting the other side of the rotating shaft, wherein one of the first supporting part and the second suppoting part has an opened loading groove for loading the roatating shaft, and a restraint part to cover the opened part of the loading groove, for preventing breaking away of the rotating shaft, and to uncover the opened part of the loading groove to provide space to load/unload the rotating shaft from the opened loading groove, the restraint part having a groove to receive the rotating shaft.

2. The door assembly as claimed in claim 1, further comprising:

a door cover on a front of the door frame; and wherein the restraint part is configured to extend from a back of the door cover.

3. The door assembly as claimed in claim 1, wherein the groove is positioned at an end of the restraint part, the grove receiving the rotating shaft inserted in the loading groove.

4. The door assembly as claimed in claim 1, wherein the loading groove is a snapping groove for snap inserting of the rotating shaft.

5. The door assembly as claimed in claim 1, wherein the opened part of the loading groove has a width smaller than a diameter of the rotating shaft.

6. The door assembly as claimed in claim 1, further comprising a third supporting part at an outer side of the at least one supporting part having the restraint pocket for inserting an end of the rotating shaft.

7. The door assembly as claimed in claim 1, wherein the at least one supporting part is formed of an elastic material.

8. The door assembly as claimed in claim 1, further comprising a spring on an outside circumference of the rotating shaft for returning the hook and the rotating shaft to original positions when the hook and the rotating shaft rotate in one direction.

9. The door assembly as claimed in claim 1, wherein the opening includes;

a pass through part for pass through of the hook, and a guide part at opposite sides of the pass through part for guiding left/right direction movement of the hook.

10. The door assembly as claimed in claim 9, wherein the guide part has a width smaller than the pass through part.

11. The door assembly as claimed in claim 1, wherein both of the first supporting part and the second supporting part have the loading groove for loading the rotating shaft.

12. The door assembly as claimed in claim 11, further comprising:

a door cover in front of the door frame; and a restraint part extended from a back of the door cover to each of the loading grooves, for preventing breaking away of the rotating shaft.

13. The door assembly as claimed in claim 12, wherein the restraint part includes an end having a groove for receiving the rotating shaft inserted in the loading groove.

14. The door assembly as claimed in claim 11, wherein the loading groove is a snapping groove.

15. The door assembly as claimed in claim 11, further comprising a third supporting part at an outer side of both the first supporting part and the second supporting part having a restraint pocket for inserting an end of the other side of the rotating shaft.

16. The door assembly as claimed in claim 11, further comprising a spring on an outside circumference of the rotating shaft for returning the hook and the rotating shaft to original positions when the hook and the rotating shaft rotate in one direction.

17. The door assembly as claimed in claim 1, wherein when the first supporting part has a pass through hole for inserting one side of the rotating shaft the second supporting part has the groove for snap insertion of the other side of the rotating shaft.

18. The door assembly as claimed in claim 17, wherein the opening includes;

a pass through part for pass through of the hook, and a guide part at opposite sides of the pass through part for guiding left/right direction movement of the hook.

19. The door assembly as claimed in claim 17, further comprising a spring on an outside circumference of the rotating shaft for returning the hook and the rotating shaft to original positions when the hook and the rotating shaft rotate in one direction, wherein a third supporting part is at an outer side of the second supporting part having the restraint pocket for inserting an end of the other side of the rotating shaft.

20. The door assembly as claimed in claim 19, further comprising:

a door cover in front of the door frame; and the restraint part extended from a back of the door cover to the groove, for preventing breaking away of the rotating shaft snapped in the groove.

21. A door assembly comprising:

a hook at one side of a cabinet for engagement with a door lock;

a rotating shaft at opposite sides of the hook;

a door frame having an opening for pass through of the hook;

a first supporting part on the door frame for supporting one side of the rotating shaft;

a second supporting part on the door frame for supporting the other side of the rotating shaft, wherein at least one supporting part of the first supporting part and the second supporting part has an opened loading groove for loading the rotating shaft into a restraint pocket having a substantially same radial dimension as a portion of the loading groove;

a door cover on a front of the door frame; and a restraint part configured to extend from a back of the door cover to the opened part of the loading groove, for preventing breaking away of the rotating shaft.

22. The door assembly as claimed in claim 21, wherein the restraint part includes an end having a groove for receiving the rotating shaft inserted in the loading groove.

23. A door assembly comprising:

a hook at one side of a cabinet for engagement with a door lock;

a rotating shaft at opposite sides of the hook;

a door frame having an opening for pass through of the hook, wherein the opening includes:

a pass through part for pass through of the hook, and a guide part at opposite sides of the pass through part for guiding left/right direction movement of the hook;

a first supporting part on the door frame for supporting one side of the rotating shaft; and a second supporting part on the door frame for supporting the other side of the rotating shaft, wherein at least one supporting part of the first supporting part and the second supporting part has an opened loading groove for loading the rotating shaft into a restraint pocket having a substantially same radial dimension as a portion of the loading groove.

24. The door assembly as claimed in claim 23, wherein the guide part has a width smaller than the pass through part.

25. A door assembly comprising:

a hook at one side of a cabinet for engagement with a door lock;

a rotating shaft at opposite sides of the hook;

a door frame having an opening for pass through of the hook;

a first supporting part on the door frame for supporting one side of the rotating shaft;

a second supporting part on the door frame for supporting the other side of the rotating shaft, wherein at least one supporting part of the first supporting part and the second supporting part has an opened loading groove for loading the rotating shaft into a restraint pocket having a substantially same radial dimension as a portion of the loading groove, and wherein when the first supporting part has a pass through hole for inserting one side of the rotating shaft the second supporting part has the groove for snap insertion of the other side of the rotating shaft;

a spring on an outside circumference of the rotating shaft for returning the hook and the rotating shaft to original positions when the hook and the rotating shaft rotate in one direction;

a third supporting part at an outside of the second supporting part having the restraint pocket for inserting an end of the other side of the rotating shaft;

a door cover in front of the door frame; and a restraint part extended from a back of the door cover to the groove, for preventing breaking away of the rotating shaft snapped in the groove.

26. A door assembly comprising:

a hook at one side of a cabinet for engagement with a door lock;

a rotating shaft at opposite sides of the hook;

a door frame having an opening for pass through of the hook, wherein the opening includes:

a pass through part for pass through of the hook, and a guide part at opposite sides of the pass through part for guiding left/right direction movement of the hook;

a first supporting part on the door frame for supporting one side of the rotating shaft; and a second supporting part on the door frame for supporting the other side of the rotating shaft, wherein at least one supporting part of the first supporting part and the second supporting part has an opened loading groove for loading the rotating shaft into a restraint pocket having a substantially same radial dimension as a portion of the loading groove, and wherein when the first supporting part has a pass through hole for inserting one side of the rotating shaft the second supporting part has the groove for snap insertion of the other side of the rotating shaft.

27. The door assembly according to claim 26, wherein the opened loading groove has a width smaller than a diameter of the rotating shaft to form the snap insertion groove.

* * * * *